US005278372A

United States Patent [19]

Takagi et al.

[11] Patent Number: 5,278,372

[45] Date of Patent: Jan. 11, 1994

[54] KEYBOARD HAVING CONNECTING PARTS WITH DOWNWARD OPEN RECESSES

[75] Inventors: Takeyuki Takagi, Nagoya; Yoshitsugu Sato, Kuwana; Makoto Watanabe, Nagoya; Isao Mochizuki, Kaizu, all of Japan

[73] Assignee: Brother Kogyo Kabushiki Kaisha, Nagoya, Japan

[21] Appl. No.: 967,428

[22] Filed: Oct. 28, 1992

[30] Foreign Application Priority Data

Nov. 19, 1991 [JP] Japan ..... 3-330160
Feb. 14, 1992 [JP] Japan ..... 4-28186

[51] Int. Cl.[5] ..... H01H 3/12
[52] U.S. Cl. ..... 200/344
[58] Field of Search ..... 200/344, 343, 517

[56] References Cited

U.S. PATENT DOCUMENTS 3,174,685 3/1965 Swanson .
3,857,007 12/1974 Leuenberger .
4,433,225 2/1984 Cowles ..... 200/344
4,560,844 12/1985 Takamura et al. ..... 200/5 A
4,560,845 12/1985 Takamura et al. ..... 200/5 A
4,580,022 4/1986 Oelsch et al. ..... 200/344
4,735,520 4/1988 Suzuki et al. ..... 200/344
4,902,862 2/1990 Oelsch et al. ..... 200/344

FOREIGN PATENT DOCUMENTS 0134509 3/1985 European Pat. Off. .
0142593 5/1985 European Pat. Off. .
0295437 12/1988 European Pat. Off. .
2175105 10/1973 France .
2-5236 1/1990 Japan .
4-76224 7/1992 Japan .

*Primary Examiner*—Renee S. Luebke
*Attorney, Agent, or Firm*—Oliff & Berridge

[57] ABSTRACT

A first support lever having an upper end provided with a pair of pivots at the opposite side ends thereof and a lower end provided with a pair of pivots at the opposite side ends thereof, and a second support lever having an upper end provided with a pair of pivots at the opposite side ends thereof and a lower end provided with a pair of pivots at the opposite side ends thereof are pivotally joined together in a scissors-like form. The pivots of the respective upper ends of the first and second support levers are connected movably to the lower surface of a key, and the pivots of the lower end of the first support lever are received pivotally in downward open, substantially round recesses formed in a base plate at positions in the opposite corners of one end of an opening formed in the base plate. The pivots of the lower end of the second support lever are received slidably in downward open, elongate recesses formed in the base plate at positions in the opposite corners of the other end of the opening. The pivots of the lower ends of the first and second support levers can easily be fitted in the corresponding substantially round recesses and elongate recesses from under the base plate.

33 Claims, 11 Drawing Sheets

| | |
|---|---|
| X | (P, S ARE NOT SLIDABLE IN X-DIRECTION) AND (R1=R2=R3) |
| H | (P, S ARE NOT SLIDABLE IN X-DIRECTION) AND (R1=R2=R3=R4) |
| Y | (U, V ARE NOT SLIDABLE IN Y-DIRECTION) OR (W, Z ARE NOT SLIDABLE IN Y-DIRECTION) |
| R | U, V ARE NOT SLIDABLE IN X-DIRECTION |

KEYBOARD HAVING CONNECTING PARTS WITH DOWNWARD OPEN RECESSES

BACKGROUND OF THE INVENTION

1. Field of the Invention

The present invention relates to a keyboard to be used as an input device for word processors and personal computers.

2. Description of Related Art

A keyswitch assembly for use on such a keyboard typically has a key provided with a stem projecting from the lower surface thereof, and a key guide member formed on a base plate and provided with a guide hole receiving the stem of the key to guide the key for vertical movement.

It is desirable that the stroke of fingers is as small as possible to enable fast key operation. Keyboards of the so-called slope-sculptured type are proposed in U.S. Pat. Nos. 4,560,845 and 4,735,520. In these keyboards, the upper surfaces of the keys are formed in curved surfaces suitable for operation with fingers to improve the operability of the keys, and the keys are arranged, from the view point of human engineering, so that a downward convex envelope is tangential to the upper surfaces thereof to reduce the fatigue of the operator in operating the keys.

In such a previously proposed keyboard, it is preferable that the keys move respectively along normals to the envelope, and hence the key guide members must be arranged on a downward convex curved surface.

However, in a keyboard provided with keyswitch assemblies each having a key provided with a stem and key guide members formed on a base plate, each key guide member having a guide hole receiving the stem of the key to guide the key for vertical movement, the key is liable to tilt relative to the guide hole. Consequently, the stem of the key moves awkwardly. When the length of the key guide member is reduced to increase the stroke of the key, the key is unable to move smoothly. Therefore, the key guide member must be sufficiently long, which is an impediment to the reduction of the thickness of the keyboard.

When such keyswitch assemblies provided with the key having the stem are applied to a keyboard of a slope-sculptured type, the key guide members must be formed having a tubular shape so as to extend respectively in different directions. Accordingly, a plurality of slide dies must be used in forming the base plate by molding a resin. Alternatively, a base plate formed in a flat shape by molding must be curved by an additional shaping process, which increases the manufacturing cost of the keyboard.

SUMMARY OF THE INVENTION

It is an object of the present invention to provide a keyboard provided with keyswitch assemblies each having a key and a key support means, and a base plate supporting the keyswitch assemblies, formed by pressing a thin metal plate or by injection-molding a synthetic resin, wherein the connecting parts of the base plate are so shaped as to facilitate connecting the support means to the base plate.

Another object of the present invention is to provide a keyboard provided with keyswitch assemblies capable of being arranged so as to form a curved operating surface.

A keyswitch assembly in accordance with the present invention comprises a key having a pair of rounded recesses and a pair of elongated slots; a base plate having a pair of downwardly open rounded recesses and a pair of downwardly open elongated slots; a key support means for supporting the key for vertical movement with respect to the base plate comprising first and second levers, the first lever having a first end with a pair of pivots, a second end with a pair of pivots, and a body, the first end pivots and the second end pivots connected to the recesses of the key and the downwardly open slots of the base plate, respectively, the second lever having a first end with a pair of pivots, a second end with a pair of pivots and a body, the first end pivots and the second end pivots connected to the slots of the key and the downwardly open recesses of the base plate, respectively, the body of the first lever and the body of the second lever being pivotally joined forming a scissors-type mechanism with a pivot joint; and switching means coupled between the key and the base plate for making an electrical connection upon compression of the key support means.

A keyboard in accordance with the present invention comprises a plurality of keys, each key having an upper surface and a lower surface with a pair of opposed rounded recesses and a pair of opposed elongated slots; a base plate having a plurality of openings disposed beneath the keys, each opening generally aligned with each key and each opening having a pair of opposed downwardly open rounded recesses and a pair of opposed downwardly open elongated slots; key support mechanisms for supporting each of the keys in generally vertical movement with respect to the plate, each mechanism comprising first and second pivotally connected levers, the first lever having a pair of opposed pivots on each end, the pair of pivots on one end pivotally connected to the pair of recesses in the key and the pair of pivots on the other end slidably connected to the slots in the base plate, the second lever having a pair of opposed pivots on each end, the pair of pivots on one end slidably connected to the slots on the key and the pair of pivots on the other end pivotally connected to the recesses in the base plate; and switching elements disposed in each of the openings of the base plate having a movable contact for electrical connection with contacts beneath the keys upon depression of the keys.

In connecting the respective lower ends of the first support lever and the second support lever, which are pivotally joined together in a scissors-like form, to the second connecting parts of the base plate, formed on the edges of an opening for receiving the switching member therein so as to open downward, the lower ends of the first and second support levers are passed through the opening to the lower side of the base plate, and then, the lower ends of the first and second support levers are fitted in the openings of the connecting parts of the base plate from under the base plate.

The openings of the connecting parts opening downward are formed in parallel to each other. Accordingly, even if the base plate is formed in a downward convex shape, the base plate can easily be molded by using a simple molding die.

BRIEF DESCRIPTION OF THE DRAWINGS

The above and other objects, features and advantages of the present invention will become more apparent from the following description taken in connection with the accompanying drawings, in which:

FIG. 13(A) is a schematic drawing of a side view of the key support mechanism shown in FIG. 1 showing the positional relationships of the levers and the directions of restricted movement of the key;

FIG. 13(B) is a schematic drawing of a plan view of the key support mechanism shown in FIG. 6 showing the directions of restricted movement of the key.

DETAILED DESCRIPTION OF PREFERRED EMBODIMENTS

Figure 1:
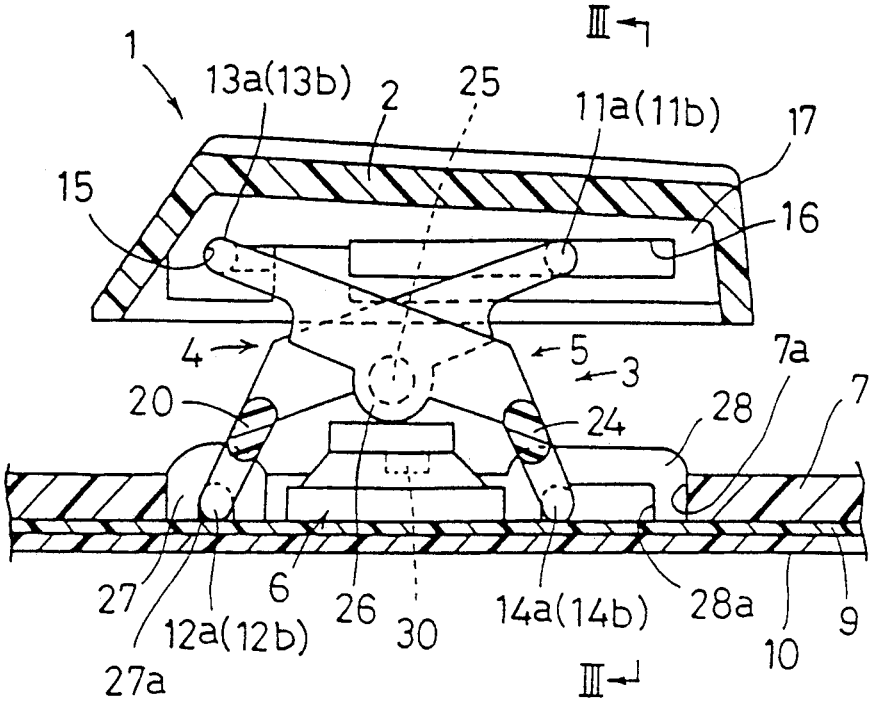
FIG. 1 is a sectional side view of a keyswitch assembly incorporated into a keyboard in a first embodiment according to the present invention.

Referring to FIG. 1 showing one of a plurality of keyswitch assemblies 1 of a keyboard in a first embodiment according to the present invention, the keyswitch assembly 1 comprises a key 2; a key support mechanism 3 formed by pivotally joining a first support lever 4 and a second support lever 5 in a scissors-like form; a rubber spring 6 to be compressed by the key support mechanism 3, having the shape of an inverted cup; a base plate 7 formed of a synthetic resin and supporting the key support mechanism 3 thereon; a printed wiring or circuit board 9 provided with pairs of switching elements 29 (FIG. 7) and underlying the base plate 7 so that each pair of switching elements 29 are located in an opening 7*a* formed in the base plate 7; and a reinforcing plate 10 attached to the lower surface of the printed wiring board 9.

Figure 6:
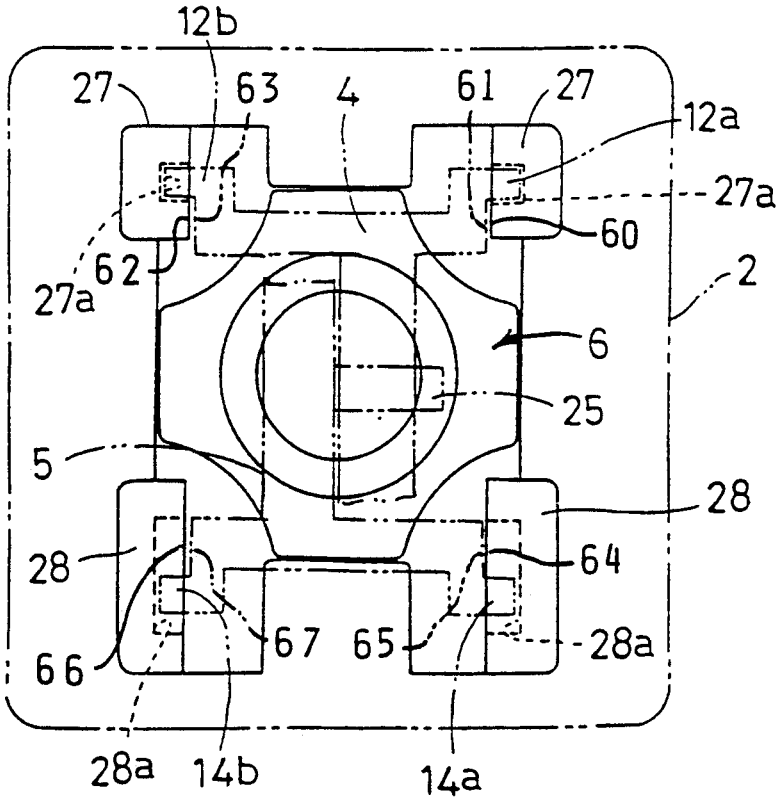
FIG. 6 is a plan view of a portion of a base plate around an opening for receiving a rubber spring.

As shown in FIGS. 1 and 6, the resilient spring 6 is fitted in the opening 7*a* of the base plate 7 so as to cover the pair of switching elements 29 (FIG. 7) of the printed wiring board 9. The spring 6 is hollow and is preferably formed of electrically insulating silicone rubber or EPDM (ethylene-propylene diene methylene). As shown in FIG. 1, the spring 6 has a circular upper wall of a relatively large thickness, a side wall having the shape of the side wall of a truncated cone, and an annular flange of a relatively large thickness extending radially outward from the bottom circumference of the side wall, preferably integrally formed as a unitary piece. The upper wall of the rubber spring 6 is pressed by pressing portions 26 of the first support lever 4 and the second support lever 5 when the key 2 is depressed. A movable contact 30 formed of a conductive rubber is fixedly attached to the inner surface of the upper wall of the rubber spring 6. When the rubber spring 6 is compressed, the movable contact 30 comes into contact with the switching elements 29 of the printed wiring board 9 to connect the switching elements 29 electrically to each other. It is also possible to form the rubber spring 6 of a conductive material, such as silicone rubber containing uniformly dispensed conductive powder, such as carbon black, so that the spring 6 acts as a contact to electrically connect the switching elements 29 when the spring is compressed toward the wiring board 9.

Figure 5:
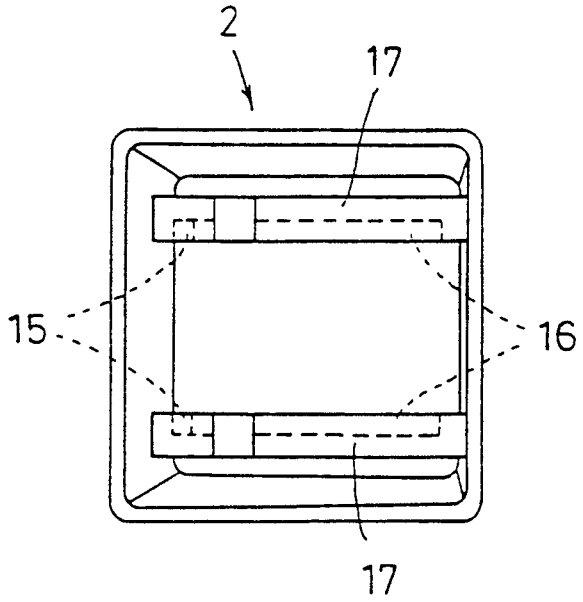
FIG. 5 is a bottom view of a key.

A character, such as an alphabetic character or the like, is formed by printing or the like on the upper surface of the key 2 preferably formed of a synthetic resin, such as ABS resin, by molding. As shown in FIG. 5, a pair of projections 17 are formed integrally with the key 2 on the inner surface of the key 2 or are attached to the inner surface of the key 2 by adhesive for example. The projections 17 are provided with facing elongated slots or grooves 16 for guiding pivots 11*a* and 11*b* formed on the upper end of the first support lever 4 in substantially horizontal, back-and-forth sliding movement, and round recesses 15 for pivotally receiving pivots 13*a* and 13*b* formed on the upper end of the second support lever 5.

The first support lever 4 and the second support lever 5, preferably formed of a glass fiber reinforced synthetic resin, will be described with reference to FIGS. 1, 4(A), 4(B) and 6. The first support lever 4 is formed by molding an integral piece having a shape resembling the letter H, and has a body 18, an upper bar 19 and a lower bar 20, the upper bar 19 and lower bar 20 being generally parallel. A hole 21 is formed laterally across the side walls of the body 18. The lower bar 20 has arms 20*a* and 20*b* extending outwardly and pivots 12*a* and 12*b* projecting in opposite directions from the respective extremities of the arms 20*a* and 20*b*, respectively. The outer longitudinally extending surfaces of the arms 20*a* and 20*b* have lateral stop surfaces 61 and 63, respectively, as shown in FIG. 6. The pivots 11*a* and 11*b* project laterally from the opposite ends of the upper bar 19.

The second support lever 5 is preferably formed by molding an integral piece having a shape resembling the letter H and has a body 22, an upper bar 23, a lower bar 24 and a shaft 25 laterally projecting from one side surface of the body 22. In connecting the first support lever 4 and the second support lever 5, the shaft 25 is fitted in the hole 21 of the first support lever 4 so that the first support lever 4 and the second support lever 5 are able to turn relative to each other.

The lower bar 24 of the second support lever 5 has arms 24*a* and 24*b* extending outwardly and provided at their extremities with pivots 14*a* and 14*b*, respectively. The outer longitudinally extending surfaces of the arms 24*a* and 24*b* have lateral stop surfaces 65 and 67, respectively, as shown in FIG. 6. Pivots 13*a* and 13*b* project laterally from the opposite ends of the upper bar 23. The longitudinal distance between the pivot 11*a* and the hole 21, the longitudinal distance between the pivot 12*a* and the hole 21, the longitudinal distance between the pivot 13*a* and the shaft 25 and the longitudinal distance between the pivot 14*a* and the shaft 25 are all equal to each other. Thus, the first support lever 4 turns on the pivots 12*a* and 12*b* when the support mechanism 3 performs linkage motion to maintain the key 2 in a position parallel to the upper surface of the base plate 7 during vertical movement.

Figure 2:
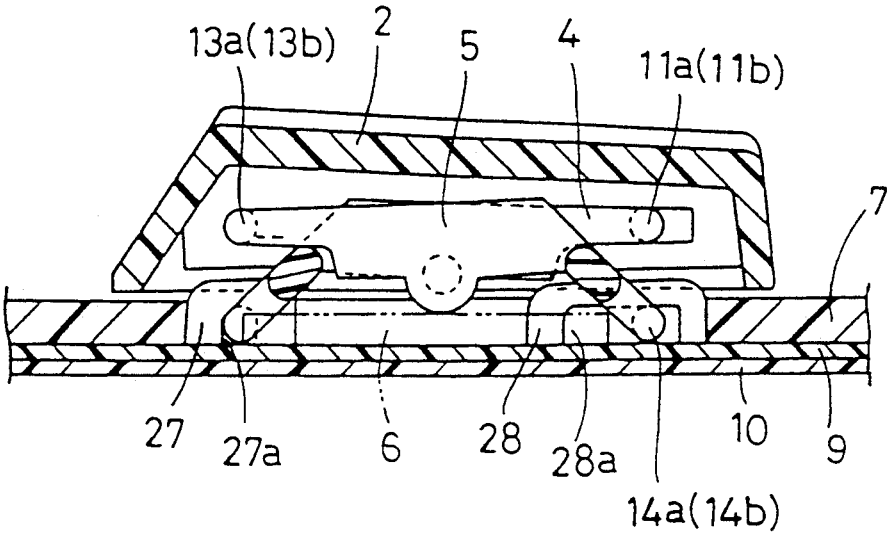
FIG. 2 is a sectional side view similar to FIG. 1, in which a key is depressed.

The respective lower surfaces of the body 18 of the first support lever 4 and the body 22 of the second support lever 5 may have downward convex pressing portions 26, shown in FIGS. 1 and 2, which are brought into contact with the upper surface of the upper wall of the rubber spring 6 to compress the rubber spring 6.

Figure 7:
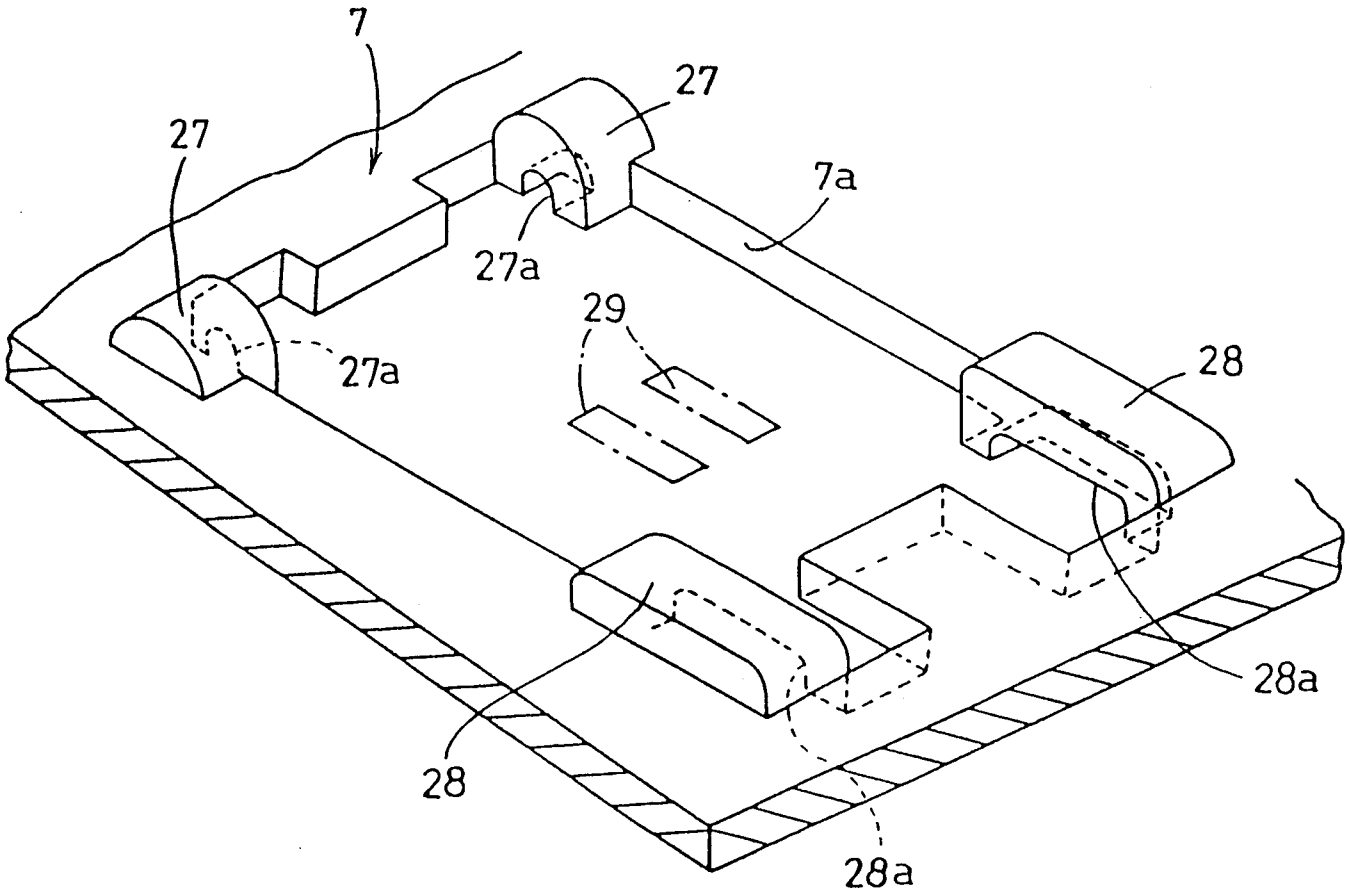
FIG. 7 is a perspective view of a portion of the base plate.

FIGS. 6 and 7 show a portion of the base plate 7, preferably formed of a glass fiber reinforced synthetic resin. As shown in FIGS. 6 and 7, the base plate 7 employed in this embodiment has the shape of a flat plate. The flange of the rubber spring 6 fits within the substantially rectangular opening 7*a* of the base plate 7. The base plate 7 is provided with a pair of upwardly protruding formations or connecting parts 27 which define round recesses 27*a* opening downward respectively at the opposite corners on one end of the opening 7*a*, and a pair of upwardly protruding formations or connecting parts 28 which define longitudinally elongate slots or recesses 28*a* opening downward respectively at the opposite corners on the other end of the opening 7*a*. The connecting parts 27 and 28 have lateral stop surfaces 60, 62, 64 and 66.

The base plate 7 shown in FIG. 7 is flat and is preferably formed by injection molding in an integral piece. Since the round recesses 27*a* and the elongate recesses 28*a* are formed so that the side surfaces thereof are perpendicular to the lower surface of the base plate 7, the base plate 7 can readily be ejected from the molding die and the molding die need not be provided with any slide die.

In assembling the key 2, the support levers 4 and 5, and the base plate 6 together, first the support levers 4 and 5 are pivotally joined together in a scissors-like form by fitting the shaft 25 in the hole 21. The upper pivots 11*a* and 11*b* of the first support lever 4 are fitted in the grooves 16 of the projections 17 of the key 2 to act as sliding formations. The upper pivots 13*a* and 13*b* of the second support lever 5 are fitted in the round recesses 15 of the projections 17 of the key 2. The first support lever 4 is turned on the shaft 25 of the second support lever 5 so that the lower pivots 12*a* and 12*b* of the first support lever 4 approach the lower pivots 14*a* and 14*b* of the second support lever 5, and the lower portions of the support levers 4 and 5 are passed through the opening 7*a* so as to project downward from the base plate 7. The lower pivots 12*a* and 12*b* of the first support lever 4 and the lower pivots 14*a* and 14*b* of the second support lever 5 are fitted in the round recesses 27*a* and the elongate recesses 28*a*, respectively, from under the base plate 7. The pivots 14*a* and 14*b* act as sliding formations. Then, the printed wiring board 9 is attached firmly to the lower surface of the base plate 7.

Figure 3:
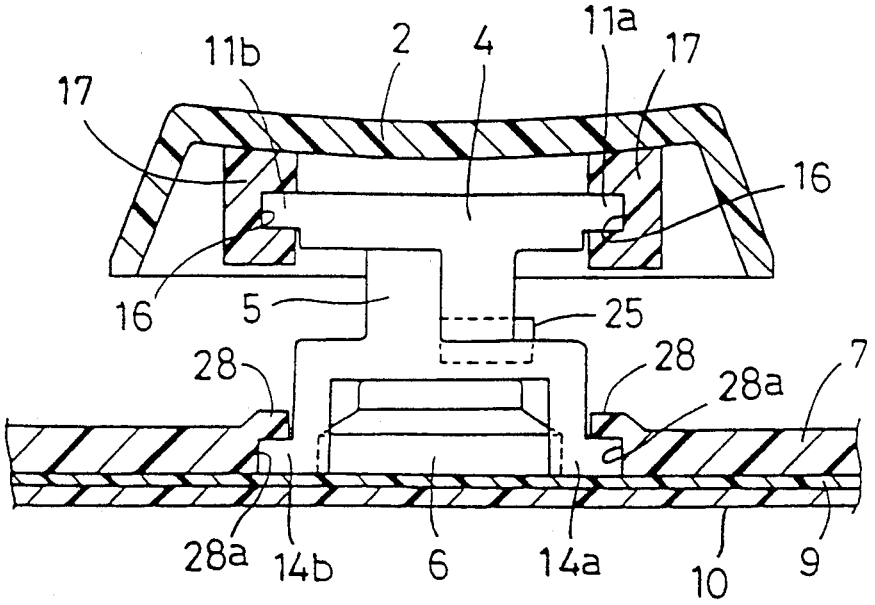
FIG. 3 is a sectional side view taken on line III—III in FIG. 1.
Figure 4A:
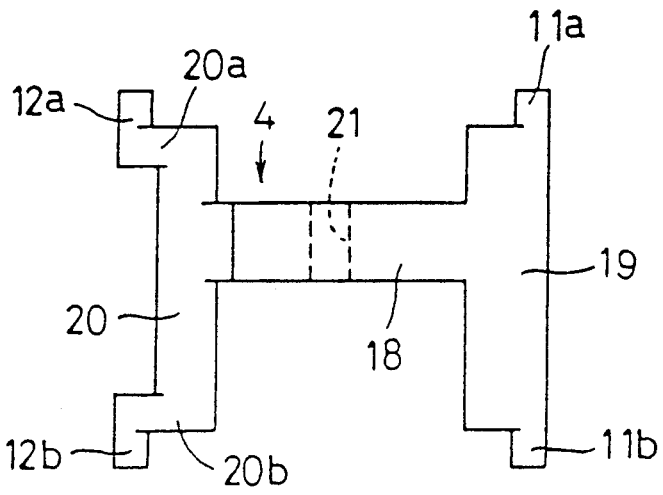
FIG. 4(A) is a plan view of a first support lever.
Figure 4B:
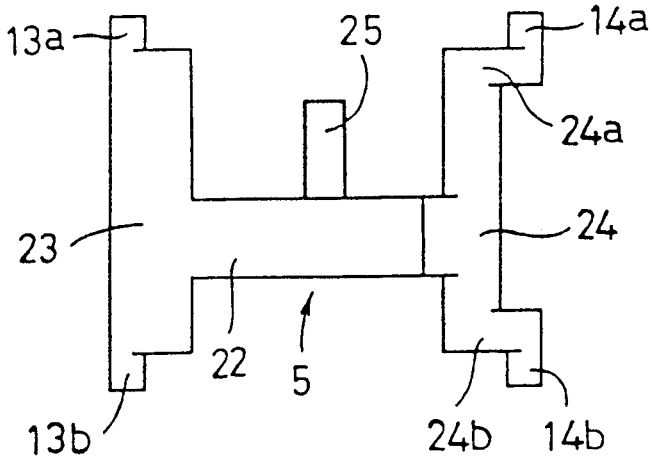
FIG. 4(B) is a plan view of a second support lever.

The shapes and sizes of the pivots 11*a*, 11*b*, 12*a* and 12*b* and lateral stop surfaces 61 and 63 of the first support lever 4, the pivots 13*a*, 13*b*, 14*a* and 14*b* and the lateral stop surfaces 65 and 67 of the second support lever 5, the recesses 15 and grooves 16 of the projections 17, the stop surfaces 60 and 63 of the formations 27 and the stop surfaces 64 and 66 of the formations 28 are determined so that the first support lever 4 and the second support lever 5 are laterally immovable, namely, movable neither to the right nor to the left as viewed in FIG. 3. However, the pivots 11*a* and 11*b*, and the pivots 14*a* and 14*b* are able to slide smoothly respectively along the grooves 16 and the elongate recesses 28*a*, and the extremities of the pivots 11*a* and 11*b* and the pivots 14*a* and 14*b* are in sliding contact with the bottom surfaces of the corresponding grooves 16 and the elongate recesses 28*a*. Accordingly, the shaft 25 is unable to come out of the hole 21.

Figure 13C:
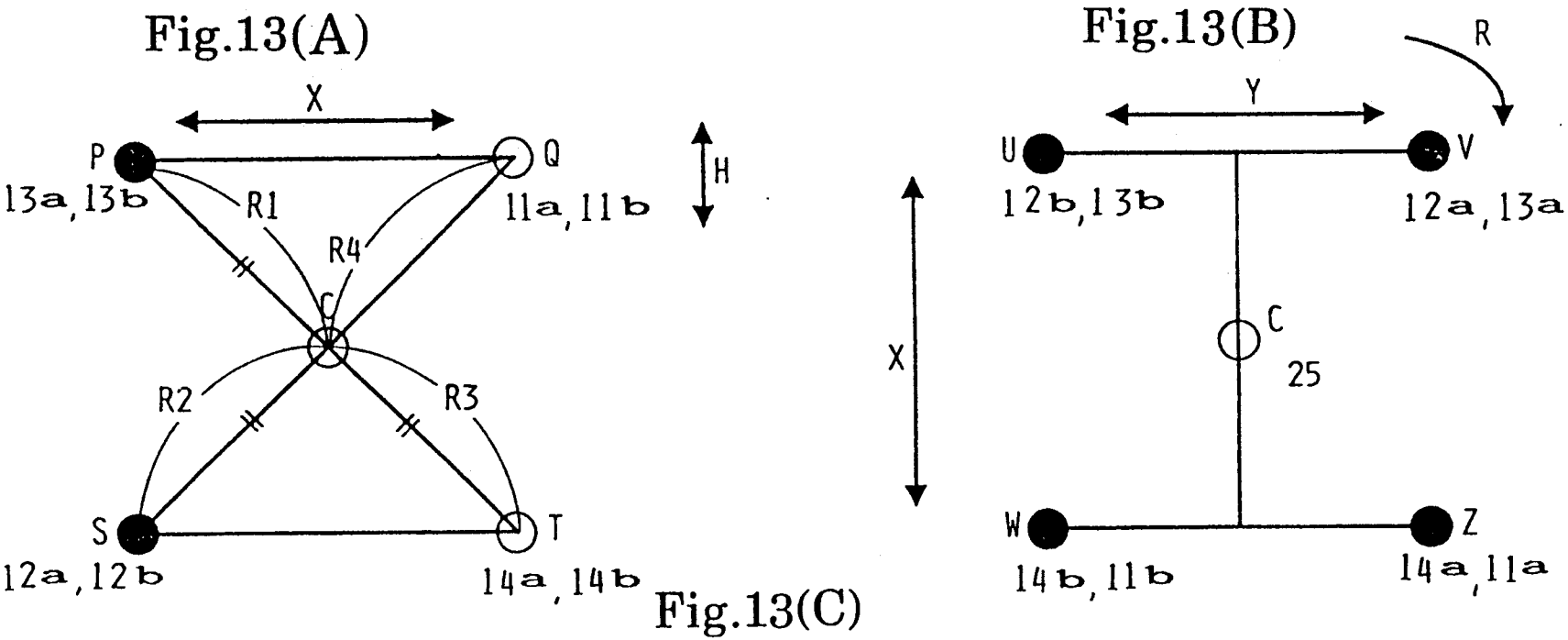
FIG. 13(C) is a chart explaining the movement arrows in FIGS. 13(A) and 13(B).

FIGS. 13(A), 13(B) and 13(C) schematically depict the movement of the key support mechanism 3. The levers 4 and 5 are pivotally connected at pivot axis C along shaft 25. As shown, the distance between at least three, and preferably all, of the pivots and the pivot axis is the same. Specifically, the distance R1 between the pivot axis connecting pivots 13*a* and 13*b*, shown as point P in FIG. 13(A), and the pivot axis C, the distance R2 between the pivot axis connecting pivots 12*a* and 12*b*, shown as point S in FIG. 13(A), and the pivot axis C, the distance R3 between the pivot axis connecting pivots 14*a* and 14*b*, shown as point T in FIG. 13(A), and the pivot axis C, and the distance R4 between the pivot axis connecting pivots 11*a* and 11*b*, shown as point Q in FIG. 13(A), and the pivot axis C are equal. This relationship limits the longitudinal, transverse and rotational movement of the key as described below.

Since R1, R2 and R3 are equal, the upper end P of the lever 5 and the lower end S of the lever 4 are not slidable in the longitudinal or X direction as shown by the arrow X in FIGS. 13(A) and 13(B) and described in the "X" row in the chart of FIG. 13(C).

In addition, when the distances R1, R2, R3 and R4 are equal, the upper end P of lever 5 and the lower end S of lever 4 are not slidable in the X direction which prevents longitudinal rotation about the X axis and lateral rotation about the Y axis. Thus, the key remains horizontally level and does not tilt as shown by the H arrow in FIG. 13(A) and described in the "H" row of FIG. 13(C). Preferably, the distance R4 is the same as R1, R2 and R3 for stability. However, if R4 is longer or shorter, the key will be inclined but still immovable in the X direction.

Also, due to the lateral stop surfaces on the levers and the connecting parts discussed above, all of the ends of the levers 4 and 5 labelled as points U, V, W and Z are laterally immovable in the Y direction as shown by the Y arrow in FIG. 13(B) and described in the "Y" row in FIG. 13(C).

Further, the vertically aligned lower end 12*b* of one side of the lower arm 20*b* of lever 4 and the upper end 13*b* of one side of the upper arm 23 of lever 5, labelled as point U in FIG. 13(B), and the vertically aligned lower end 12*a* of the other side of the lower arm 20*a* of lever 4 and the upper end 13*a* of the other side of upper arm 23 of lever 5, labelled as point V in FIG. 13(B) are not slidable in the X direction which prevents rotation about the vertical or Z axis as depicted by arrow R in FIG. 13(B) and described in the "R" row of the chart of FIG. 13(C).

Thus, all directions of movement of the key, except the vertical direction with respect to the base plate, are restrained by the spacial arrangement of the ends of the levers, i.e. the pivots, with respect to the central pivot axis of the linkage and by the lateral stop surfaces on the levers and on the base plate and key. Also, the movement of the key in the vertical direction is limited by the ends of the elongated slots on the keys and the base plate. The result is an extremely stable key which will not tilt or turn regardless of where the operator presses on the surface of the key.

When the key 2 is depressed, the first support lever 4 turns clockwise, as viewed in FIG. 1, on the pivots 12*a* and 12*b* fitted in the round recesses 27*a* of the base plate 7, and the second support lever 5 turns counterclockwise, as viewed in FIG. 1, on the shaft 25 thereof. The pressing portions 26 of the support levers 4 and 5 depress the upper wall of the rubber spring 6 to bring the movable contact 30 attached to the inner surface of the upper wall into contact with the switching elements 29 for switching operation.

Figure 8:
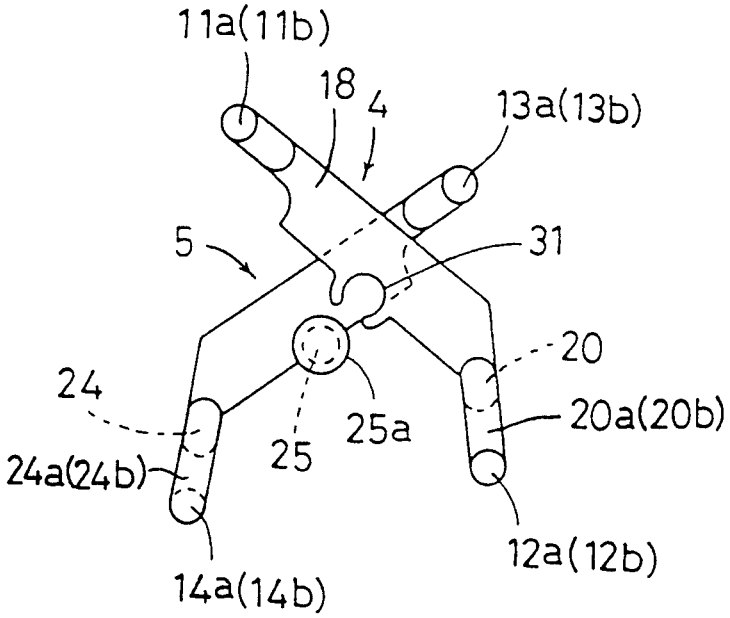
FIG. 8 is an exploded side view of assistance in explaining a manner of pivotally connecting a modified pair of support levers.
Figure 9:
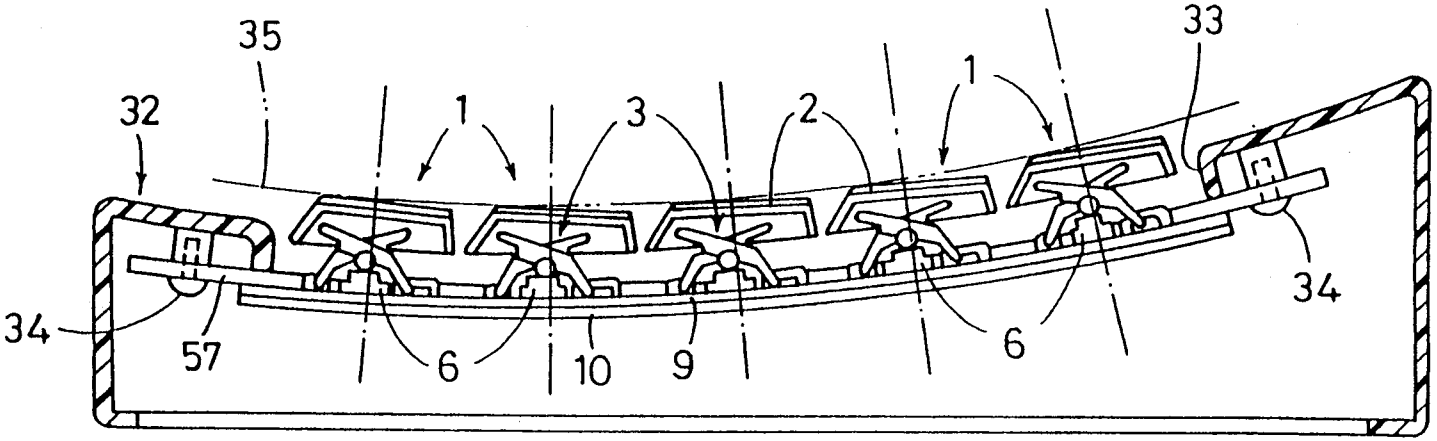
FIG. 9 is a side view in partial section of a keyboard in a second embodiment according to the present invention.

FIG. 8 shows a key support mechanism in a modification of the key support mechanism 3. The key support mechanism shown in FIG. 8 consists of a first support lever 4 provided with a downward opening recess or groove 31 having a sectional shape substantially resembling the letter C in the middle portion of the lower surface thereof, and a second support lever 5 provided with a shaft 25 having an enlarged head 25*a*. The shaft 25 of the second support lever 5 is snapped into the recess 31 of the first support lever 4 to join the first support lever 4 and the second support lever 5 together in a scissors-like form. This key support mechanism further facilitates work for connecting key support mechanism to the base plate 7.

A keyboard in a second embodiment according to the present invention will be described hereinafter with reference to FIGS. 9 to 12. The aspects of the second embodiment which are similar to the first embodiment will not be described in detail. The keyboard comprises a plurality of keyswitch assemblies an upper case 32 having an opening 33 preferably formed of a synthetic resin, and a base plate 57 having a downward convex curved shape and fastened to the upper case 32 with screws 34. When the keyswitch assemblies 1 are arranged on the base plate 57, a downward convex envelope 35 is formed parallel to the upper surface of the base plate 57 and tangent to the upper surfaces of the keys 2 of the keyswitch assemblies 1.

The keys 2, a first support lever 4, a second support lever 5 and a rubber spring 6 included in the keyboard 1 in the second embodiment are the same in shape and construction as those of the keyboard 1 in the first embodiment, and hence the description thereof will be omitted.

Prior art keyboards with base plates having a downward convex curved shape, such as shown in U.S. Pat. No. 4,735,520, are provided with keyswitch assemblies each having a key provided with a stem, and arranged on the base plate so that a downward convex envelope is tangent to all the upper surfaces of the keys thereof. Key guide members are formed integrally with the base plate and each have a guide hole receiving the stem of the key to guide the key for movement along a normal to the downward convex envelope. An injection-molding die required to form such base plates consists of a pair of mating dies, and a plurality of slide dies provided on one of the pair of mating dies to form the guide holes so as to be slidable along normals to the downward convex surface of the die corresponding to the lower surface of the base plate, respectively. After the molten synthetic resin introduced into the cavity of the injection-molding die has solidified, the slide dies must be retracted along the normals, respectively, to enable the molded base plate to be removed from the injection-molding die. Such an injection-molding die having a complex structure is costly and requires additional steps of setting the slide dies in place before molding and retracting the slide dies before removing the molded base plate from the injection-molding die, which increases the manufacturing cost of the keyboard.

Figure 10:
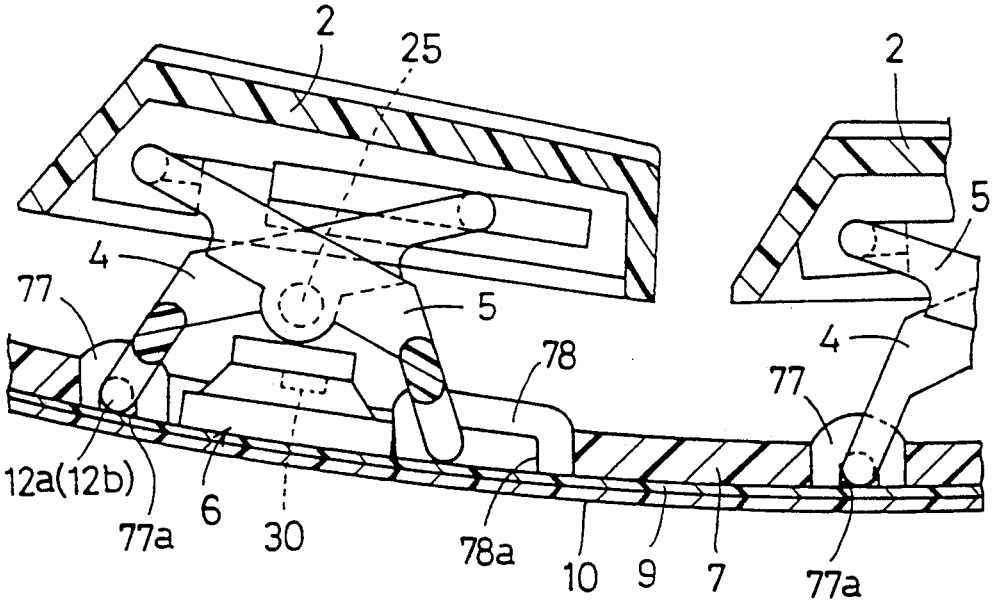
FIG. 10 is an enlarged fragmentary sectional side view of the keyboard of FIG. 9.
Figure 11:
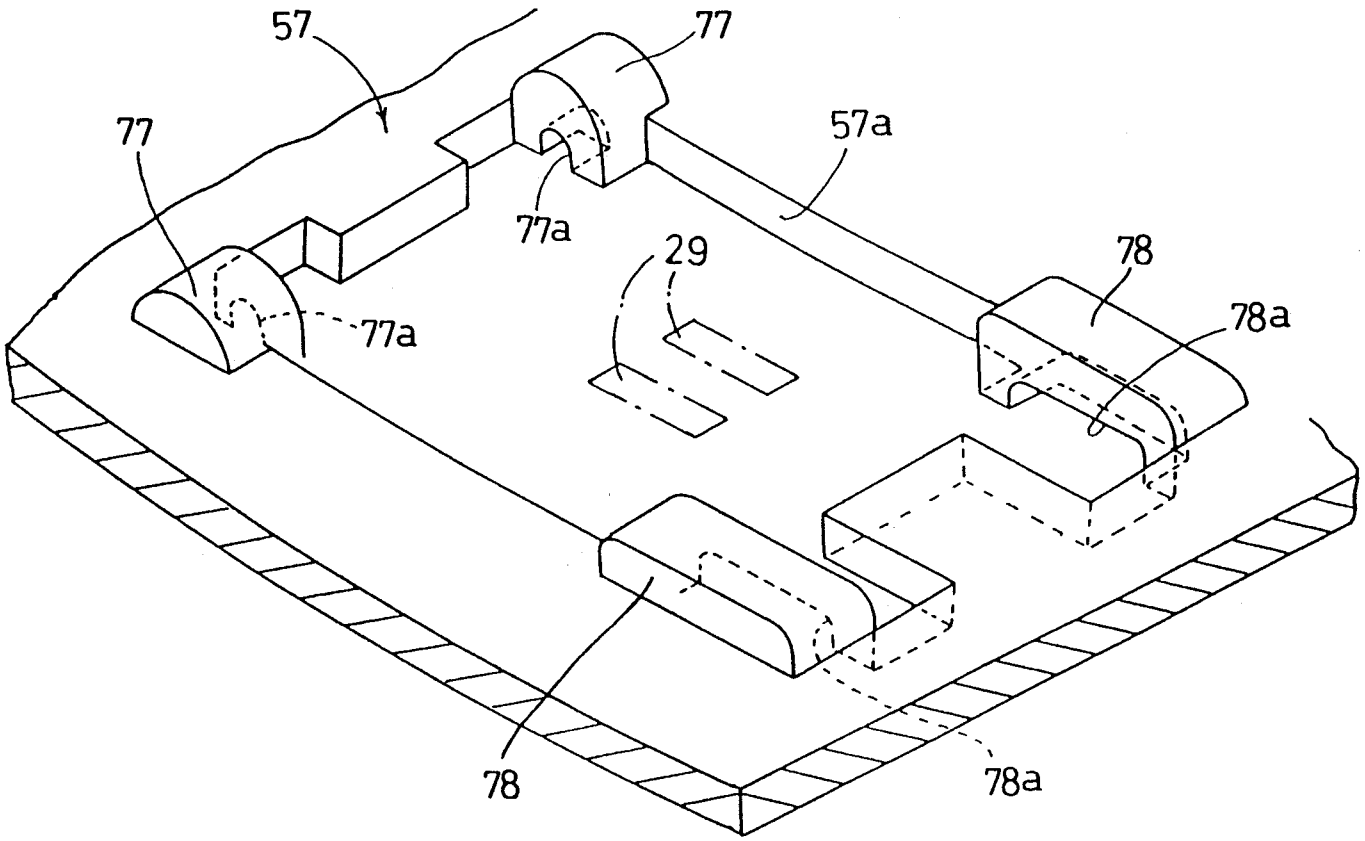
FIG. 11 is a fragmentary perspective view of a base plate employed in the keyboard of FIG. 9.
Figure 12:
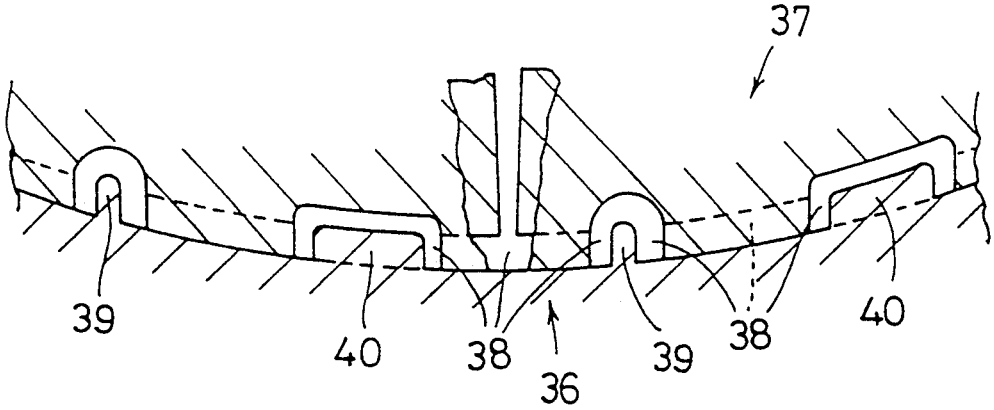
FIG. 12 is sectional view of a molding die for molding the base plate of the keyboard of FIG. 9.

In the second embodiment of the present invention, the side surfaces of the downward open round recesses 77*a* formed respectively in the opposite corners on one end of the opening 57*a* of the base plate 57, and the side surfaces of the downward open elongate slots or recesses 78*a* formed respectively in the opposite corners on the other end of the opening 57*a* are parallel to each other as shown in FIGS. 10, 11 and 12. Although the side surfaces of the round recesses 77*a* and the elongate recesses 78*a* are parallel to each other, the lower pivots 12*a* and 12*b* of the first support lever 4 and the lower pivots 14*a* and 14*b* of the second support lever 5 are on a curved surface similar to the downward convex envelope 35, so that the downward convex envelope 35 is tangent to the upper surfaces of all the keys 2 and the keys 2 move along the normals to the downward convex envelope 35, respectively. A printed wiring board 9 is attached to the lower surface of the base plate 57 and a reinforcing plate 10 is attached to the printed wiring board 9.

As seen in FIG. 12, the base plate 57 is integrally formed with the connecting parts 77 provided with the round recesses 77*a* and the connecting parts 78 provided with the elongate recesses 78*a*. In molding, a molten synthetic resin is introduced into a cavity 38 formed between a pair of mating dies 36 and 37, shown in FIG. 12. Then, the die 36, provided with projections 39 and 40 corresponding respectively to the round recesses 77*a* and the elongate recesses 78*a*, is moved away from the other die 37 in a direction parallel to the parallel side surfaces of the round recesses 77*a* and the elongate recesses 78*a*.

Accordingly, the projections 39 and 40 may be formed integrally with the die 36, and the die 36 can be separated from the die 37 without requiring any additional work. Thus, the base plate 57 can be formed by a simple molding operation using an inexpensive, simple injection-molding die.

Naturally, the base plate 57 may be formed integrally with the upper case 32.

Furthermore, the flat base plate 7 employed in the first embodiment and the downward convex base plate 57 employed in the second embodiment may be formed by diepressing a thin aluminum plate or a thin steel plate by using pressing dies similar to the injection-molding dies.

The printed wiring board 9 provided with the switching elements 29 may be substituted by a wiring board provided with membrane switches. The present invention is applicable also to a variable-capacity keyboard.

While advantageous embodiments have been chosen to illustrate the invention, it will be understood by those skilled in the art that various changes and modifications can be made therein without departing from the scope of the invention as defined in the appended claims.

What is claimed is:

1. A keyswitch comprising:

a key with a lower surface having a pair of rounded recesses and a pair of elongated slots;

a base plate having an opening disposed beneath said key defined by an edge and a pair of open rounded recesses and a pair of open elongated slots, both said recesses and said slots opening away from said lower surface of said key and being formed in said edge of said base plate defining said opening;

a key support for supporting said key for vertical movement with respect to said base plate comprising first and second levers pivotally joined forming a scissors-type linkage with a pivot axis, said first lever having a first end with a first pivot mechanism for pivoting and a second end with a first sliding mechanism for sliding longitudinally with respect to said key, said first pivot mechanism and said first sliding mechanism connected to said recesses of said key and said slots of said base plate, respectively, said second lever having a first end with a second pivot mechanism for pivoting and a second end with a second sliding mechanism for sliding longitudinally with respect to said key, said second sliding mechanism and said second pivot mechanism connected to said slots of said key and said recesses of said base plate, respectively; and a switch coupled between said key and said base plate for making an electrical connection upon compression of said key support.

2. The keyswitch assembly according to claim 1, wherein said base plate has an upper surface and a lower surface, said rounded recesses and elongated slots opening to said lower surface of said base plate and each having side walls which are substantially perpendicular to said lower surface of said base plate.

3. The keyswitch assembly according to claim 1, wherein said base plate is downwardly convex.

4. The keyswitch assembly according to claim 3, wherein said recesses and said slots have sidewalls which are substantially parallel to each other.

5. The keyswitch assembly according to claim 3, wherein said recesses and said slots have sidewalls which are substantially normal to a support surface for the keyswitch.

6. The keyswitch assembly according to claim 3, further comprising a plurality of said keys each having an upper surface and arranged on said base plate such that a tangent to the upper surface of each of said keys is generally parallel to a portion of said base plate disposed under each respective key.

7. The keyswitch assembly according to claim 1, wherein said switch comprises a resilient member disposed between said base plate and said key support beneath said pivot axis.

8. The keyswitch assembly according to claim 1, wherein each of said first and second levers has an upper arm and a lower arm extending perpendicularly from a body.

9. The keyswitch assembly according to claim 1, wherein said opening in said base plate is generally rectangular and disposed beneath said key support, and a pair of projections are disposed in opposed corners of said opening defining said rounded recesses and a pair of projections are disposed in opposed corners of said opening defining said elongated slots.

10. The keyswitch assembly according to claim 1, wherein said base plate is an integrally molded plate.

11. The keyswitch assembly according to claim 1, wherein said slots extend generally perpendicularly with respect to the movement of said key.

12. The keyswitch assembly according to claim 1, wherein said first lever has a shaft extending laterally therefrom and said second lever has a hole extending laterally therethrough, said shaft rotatably fitted into said hole for pivotally connecting said first and second levers.

13. The keyswitch assembly according to claim 1, wherein said first lever has a shaft with an enlarged end extending laterally therefrom and said second lever has a C-shaped groove therein, complementary to said shaft, said shaft being rotatably snap fit into said groove for pivotally connecting said first and second levers.

14. The keyswitch assembly according to claim 1, wherein a pair of electrical contacts are disposed beneath said switch and said switch has an electrical contact movable to said pair of contacts upon depression of said key.

15. The keyswitch assembly according to claim 1, said first end of said first lever, said second end of said first lever and said first end of said second lever are equally spaced from said pivot axis, and said first end of said first lever and said first end of said second lever are longitudinally immovable.

16. The keyswitch assembly according to claim 15, wherein said first end of said first lever has a pair of opposed ends aligned along a first line connecting said pair of ends, said second end of said first lever has a pair of opposed ends aligned along a second line connecting said pair of ends, and said first end of said second lever has a pair of opposed ends aligned along a third line connecting said pair of ends, wherein a shortest distance between said first line and said pivot axis, a shortest distance between said second line and said pivot axis and a shortest distance between said third line and said pivot axis are the same.

17. The keyswitch assembly according to claim 15, wherein said second end of said second lever is the same distance from said pivot axis as said second end of said first lever, and said lower surface of said key remaining horizontal with respect to the vertical movement of said key.

18. The keyswitch assembly according to claim 17, wherein said second end of said second lever has a pair of opposed ends aligned along a fourth line connecting said pair of ends, wherein a shortest distance between said fourth line and said pivot axis is the same as the shortest distance between said second line and said pivot axis.

19. The keyswitch assembly according to claim 1, wherein said first and second levers have lateral stop surfaces and said recesses and said slots of said key and said base plate have lateral stop surfaces, and said key is laterally immovable.

20. The keyswitch assembly according to claim 1, wherein said first end of said first lever and said first end of said second lever are vertically aligned.

21. The keyswitch assembly according to claim 1, wherein said second end of said first lever and said second end of said second lever are vertically aligned.

22. A keyboard comprising:

a plurality of keys, each key having an upper surface and a lower surface with a pair of opposed rounded recesses and a pair of opposed elongated longitudinally extending slots;

a base plate having an upper surface and a lower surface and a plurality of openings disposed beneath said keys, each said opening generally aligned with each said key, and said base plate further having a pair of opposed rounded recesses adjacent each said opening and open to said lower surface and a pair of opposed elongated longitudinally extending slots adjacent each said opening and open to said lower surface;

key support mechanisms for supporting each of said keys in generally vertical movement with respect to said plate, each said mechanism comprising first and second pivotally connected levers and having a pivot axis, said first lever having a pivot mechanism on one end pivotally connected to said pair of recesses in said key and a sliding mechanism on the other end slidably connected to said slots in said base plate, said second lever having a sliding mechanism on one end slidably connected to said slots on said key and a pivot mechanism on the other end pivotally connected to said recesses in said base plate; and switching elements disposed in each of said openings of said base plate having a movable contact for electrical connection with contacts beneath said keys upon depression of said keys.

23. The keyboard according to claim 22, wherein said recesses and said slots in said base plate have side walls which are generally parallel to each other.

24. The keyboard according to claim 22, wherein said recesses and said slots of said base plate have side walls which are substantially perpendicular to said lower surface of said base plate.

25. The keyboard according to claim 22, wherein said base plate is downwardly convex.

26. The keyboard according to claim 22, wherein said recesses and said slots in said base plate have side walls which are substantially normal to a support surface for the keyboard.

27. The keyboard according to claim 22, wherein said keys are arranged on said base plate so that a tangent along the upper surface of each of said keys is generally parallel to a portion of said base plate disposed under each respective key.

28. The keyboard according to claim 22, wherein said end of said first lever having said pivot mechanism, said end of said first lever having said sliding mechanism and said end of said second lever having said pivot mechanism are equally spaced from said pivot axis, and said end of said first lever having said pivot mechanism and said end of said second lever having said pivot mechanism are vertically aligned and longitudinally immovable.

29. The keyboard according to claim 28, wherein said end of said first lever having said pivot mechanism comprises a pair of opposed ends aligned along a first line connecting said pair of ends, said end of said first lever having said sliding mechanism comprises a pair of opposed ends aligned along a second line connecting said pair of ends, and said end of said second lever having said pivot mechanism comprises a pair of opposed ends aligned along a third line connecting said pair of ends, wherein a shortest distance between said first line and said pivot axis, a shortest distance between said second line and said pivot axis and a shortest distance between said third line and said pivot axis are the same.

30. The keyboard according to claim 28, wherein said end of said second lever having said sliding mechanism is the same distance from said pivot axis as said end of said first lever having said sliding mechanism, and said lower surface of said key remaining horizontal with respect to the vertical movement of said key.

31. The keyboard according to claim 30 wherein said end of said second lever having said sliding mechanism comprises a pair of opposed ends aligned along a fourth line connecting said pair of ends, wherein a shortest distance between said fourth line and said pivot axis is the same as the shortest distance between said second line and said pivot axis.

32. The keyboard according to claim 22, wherein said first and second levers have lateral stop surfaces and said recesses and said slots of said key and said base plate have lateral stop surfaces, and said key is laterally immovable.

33. A method of assembling a keyswitch assembly comprising a key, a base plate with an opening and a support mechanism for moving the key vertically with respect to the base plate, the key support mechanism including a pair of levers pivotally connected in a scissors arrangement, comprising the steps of:

providing a pair of downwardly open rounded recesses and a pair of downwardly open elongated slots in the base plate;

passing lower ends of the connected levers through the opening in the base plate; and fitting the lower ends of the levers into the recesses and slots from beneath the base plate.

* * * * *